US005454131A

United States Patent [19]

Mackenzie

[11] Patent Number: 5,454,131

[45] Date of Patent: Oct. 3, 1995

[54] APPARATUSES FOR CLEANING AND SANITIZING COMBS THROUGH MECHANICAL BRISTLES AND DISINFECTANT FLUIDS

[76] Inventor: Madeline E. Mackenzie, 17 ½ Charles St., Concord, N.H. 03301

[21] Appl. No.: 235,905

[22] Filed: May 2, 1994

[51] Int. Cl.[6] ..... B08B 3/04

[52] U.S. Cl. ..... 15/104.92; 206/209

[58] Field of Search ..... 15/104.92; 206/209, 206/212, 306

[56] References Cited

U.S. PATENT DOCUMENTS

| | | | |
|---|---|---|---|
| 3,428,988 | 2/1969 | Blackburn | 15/104.92 X |
| 3,813,722 | 6/1974 | Sapochinik | 15/104.92 |
| 4,130,909 | 12/1978 | Greene | 15/104.92 |
| 4,439,884 | 4/1984 | Giorni | 15/104.92 |
| 4,821,358 | 4/1989 | Wyckoff et al. | 15/104.92 |
| 4,865,188 | 9/1989 | Custeau | 206/209 |
| 4,945,596 | 8/1990 | Chang et al. | 15/104.92 X |
| 5,308,406 | 5/1994 | Wallock et al. | 15/104.92 X |

*Primary Examiner*—Philip R. Coe

[57] ABSTRACT

Disclosed is an apparatus for cleaning and sanitizing combs through mechanical bristles and disinfectant fluids. The apparatus includes a container having a rectangular base with enlarged rectangular front and rear walls and smaller rectangular side walls. The container further includes a lid having a lower open end which is removably positioned on the upper edges of the walls. The upper edge of the lid includes an elongated aperture for the passage of a comb therethrough. The apparatus further includes a plurality of pointed semi-rigid bristles which are secured to the interior surfaces of the front and rear walls of the container.

6 Claims, 4 Drawing Sheets

APPARATUSES FOR CLEANING AND SANITIZING COMBS THROUGH MECHANICAL BRISTLES AND DISINFECTANT FLUIDS

BACKGROUND OF THE INVENTION

1. Field of the Invention

The present invention relates to apparatus for cleaning and sanitizing combs through mechanical bristles and disinfectant fluids and more particularly pertains to cleaning and disinfecting combs through a device having a combination of bristles and disinfectant fluid.

2. Description of the Prior Art

The use of devices for holding and cleaning combs is known in the prior art. More specifically, devices for holding and cleaning combs heretofore devised and utilized for the purpose of cleaning combs and disinfecting combs through various devices are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 3,813,722 discloses a hair comb cleaning device.

U.S. Pat. No. 3,879,787 discloses a hair brush and comb cleaning apparatus.

U.S. Pat. No. 3,964,120 discloses a comb cleaner.

U.S. Pat. No. 3,982,296 discloses a hair brush and comb cleaning apparatus.

U.S. Pat. No. Des. 319,118 discloses the design of an automatic brush and comb cleaner.

In this respect, the apparatus for cleaning and sanitizing combs through mechanical bristles and disinfectant fluids according to the present invention substantially departs from the conventional concepts and designs of the prior art, and in doing so provides an apparatus primarily developed for the purpose of cleaning and disinfecting combs through a device having a combination of bristles and disinfectant fluid.

Therefore, it can be appreciated that there exists a continuing need for new and improved apparatus for cleaning and sanitizing combs through mechanical bristles and disinfectant fluids which can be used for cleaning and disinfecting combs through a device having a combination of bristles and disinfectant fluid. In this regard, the present invention substantially fulfills this need.

SUMMARY OF THE INVENTION

In view of the foregoing disadvantages inherent in the known types of devices for holding and cleaning combs now present in the prior art, the present invention provides an improved apparatus for cleaning and sanitizing combs through mechanical bristles and disinfectant fluids. As such, the general purpose of the present invention, which will be described subsequently in greater detail, is to provide a new and improved apparatus for cleaning and sanitizing combs through mechanical bristles and disinfectant fluids and method which has all the advantages of the prior art and none of the disadvantages.

To attain this, the present invention essentially comprises a new and improved apparatus for cleaning and sanitizing combs through mechanical bristles and disinfectant fluids comprising, in combination: a container having a rectangular base and enlarged rectangular front and rear walls and smaller rectangular side walls, the front and rear and side walls couple together at their edges to form a rectangular shape and coupled at their lower edges to the upper surface of the base plate; a rectangular sheet of lead integrally formed within the base plate for weighing purposes to stabilize the device; a lid formed in a trapezoidal configuration having a lower open end removably positioned on the upper edges of the front, rear and side walls, the upper edge of the lid having an elongated aperture for the passage of a comb therethrough; a water line within the container extending upwardly from the base to a distance slightly beneath the elevational midpoint of the container; and a plurality of pointed semi-rigid nylon bristles secured to the interior surfaces of the front and rear walls of the container, the bristles having axes pointing downwardly at about forty-five degrees with respect to the surface of the base plate, the needles being of a length to overlap at their tips whereby when a comb is inserted through the slot in the lid into the container it will contact and deflect the bristles toward the base plate and moisten the lower extent of the comb and, upon withdrawing the comb from the container through the lid, the bristles will be deflected upwardly at an angle away from the base plate and become moistened by the lower end of the comb moving thereadjacent for moistening all areas of the comb when reciprocated vertically between the bristles.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved apparatus for cleaning and sanitizing combs through mechanical bristles and disinfectant fluids which have all the advantages of the prior art devices for holding and cleaning combs and none of the disadvantages.

It is another object of the present invention to provide new and improved apparatus for cleaning and sanitizing combs through mechanical bristles and disinfectant fluids which may be easily and efficiently manufactured and marketed.

It is further object of the present invention to provide new and improved apparatus for cleaning and sanitizing combs through mechanical bristles and disinfectant fluids which are of durable and reliable constructions.

An even further object of the present invention is to provide new and improved apparatus for cleaning and sanitizing combs through mechanical bristles and disinfectant fluids which are susceptible of a low cost of manufacture with regard to both materials and labor, and which accordingly are then susceptible of low prices of sale to the consuming public, thereby making such apparatus for cleaning and sanitizing combs through mechanical bristles and disinfectant fluids economically available to the buying public.

Still yet another object of the present invention is to provide new and improved apparatus for cleaning and sanitizing combs through mechanical bristles and disinfectant fluids which provide in the apparatuses and methods of the prior art some of the advantages thereof, while simultaneously overcoming some of the disadvantages normally associated therewith.

Still another object of the present invention is to cleaning and disinfecting combs through a device having a combination of bristles and disinfectant fluid.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
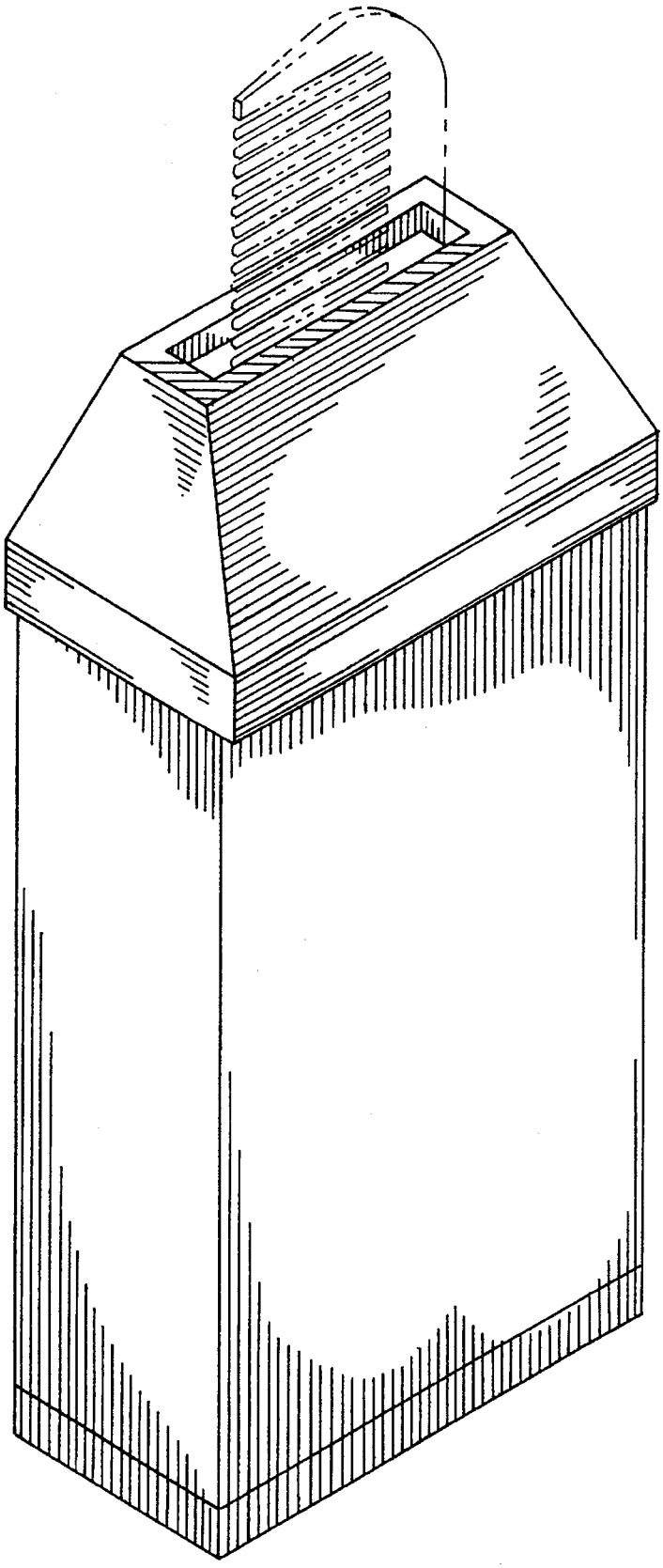
FIG. 1 is a perspective view of the preferred embodiment of the new and improved apparatus for cleaning and sanitizing combs through mechanical bristles and disinfectant fluids constructed in accordance with the principles of the present invention.
Figure 2:
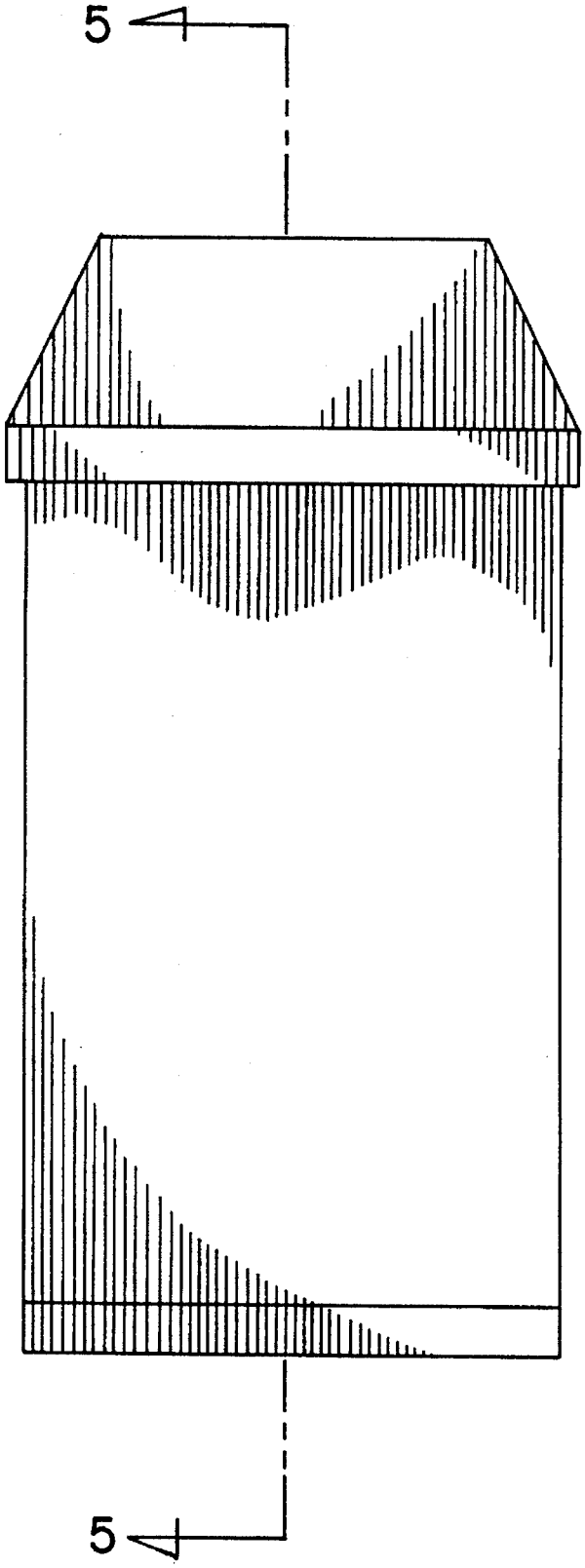
FIG. 2 is a front elevational view illustrating the device as shown in FIG. 1.
Figure 3:
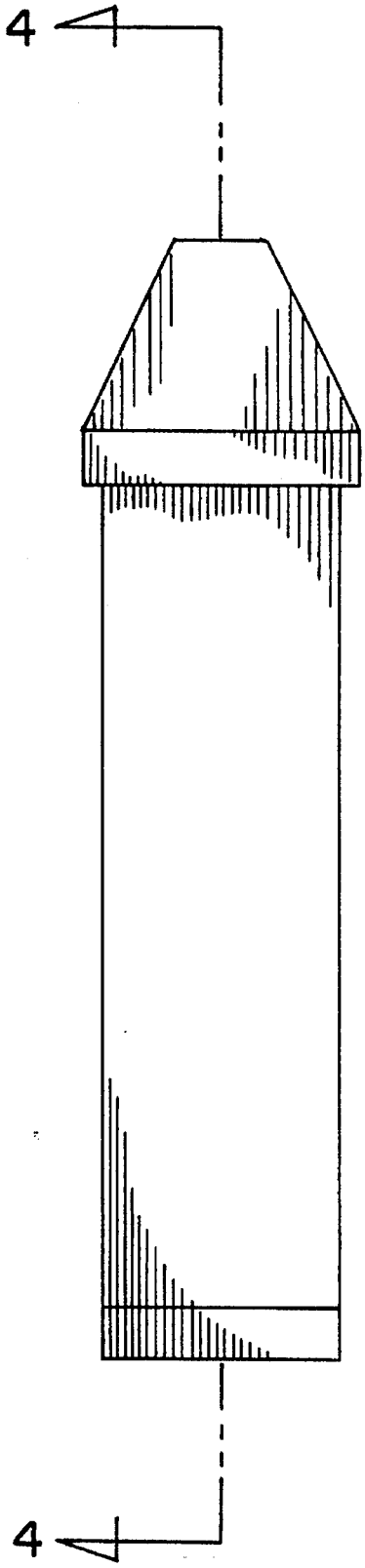
FIG. 3 is a side elevational view illustrating the device shown in FIG. 1.
Figure 4:
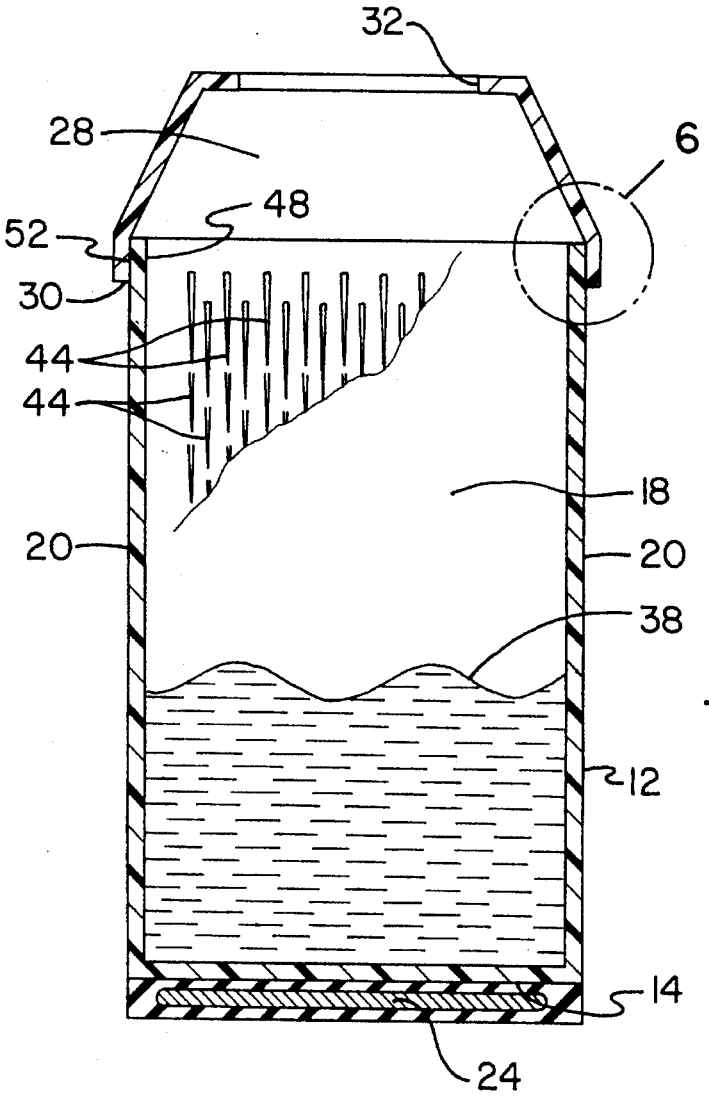
FIG. 4 is a cross-sectional view taken along lines 4—4 of FIG. 3.

With reference now to the drawings, and in particular to FIG. 1 thereof, the preferred embodiment of the new and improved apparatus for cleaning and sanitizing combs through mechanical bristles and disinfectant fluids embodying the principles and concepts of the present invention and generally designated by the reference numeral 10 will be described.

The device 10 is comprised of a plurality of components. In their broadest context, the components include a container, a rectangular sheet of lead, a lid, a water line, and a plurality of bristles. Such components are specifically configured and correlated with respect to each other so as to attain the desired objectives.

More specifically, the container 12 is formed with a rectangular base 14. The container has enlarged rectangular front 16 and rear walls 18 extending upwardly from the base. The container also has smaller rectangular side walls 20. The front and rear and side walls are coupled together at their vertical edges to form a rectangular shape when viewed in cross-section. The walls are also coupled at their lower edges to the upper surface of the base plate to form an open container.

Formed within the base plate is a rectangular sheet 24. Such rectangular sheet is formed of lead to add weight to the device. It is integrally formed therein for weighing purposes to stabilize the device.

Next provided is a lid 28. The lid is formed in a trapezoidal configuration when viewed in elevation. It has an enlarged lower open end 30. Such lower end is removably positioned on the upper edges of the front and rear and side walls of the container. The lid also has an upper edge of a reduced size. Such upper edge has an elongated aperture 32 for the passage of a comb 34 therethrough. Such comb is to be cleaned by the device.

Within the container is a water line 38. The water line is within the container and extends upwardly from the base to a predetermined distance preferably slightly beneath the elevational midpoint of the container. The container is thus adapted to receive a disinfectant fluid 40 for sanitizing the comb placed therein.

Figure 5:
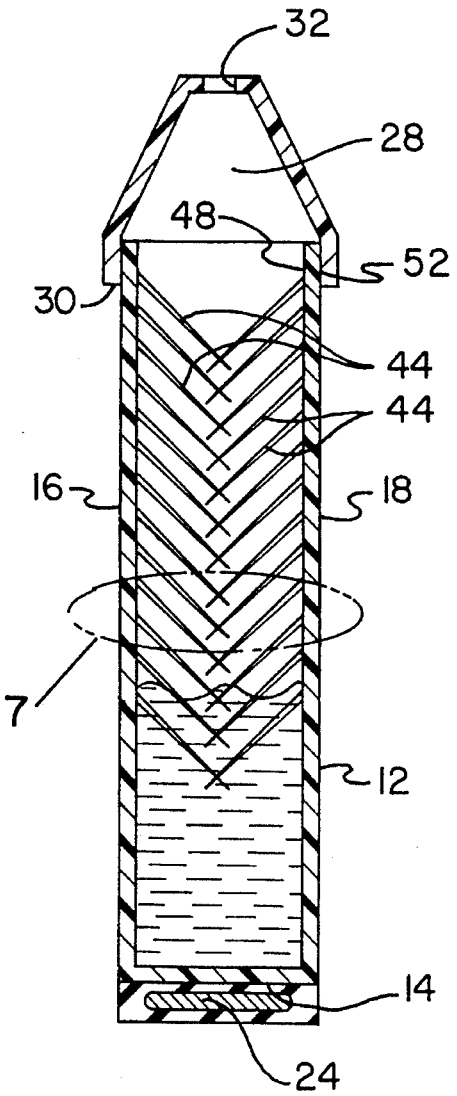
FIG. 5 is a cross-sectional view taken along lines 5—5 of FIG. 2.
Figure 6:
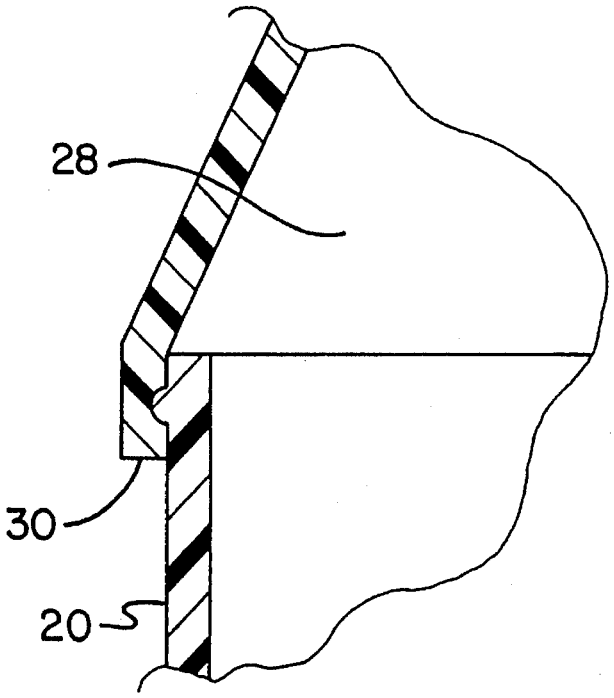
FIG. 6 is an enlarged cross-sectional view taken at circle 6 of FIG. 4.
Figure 7:
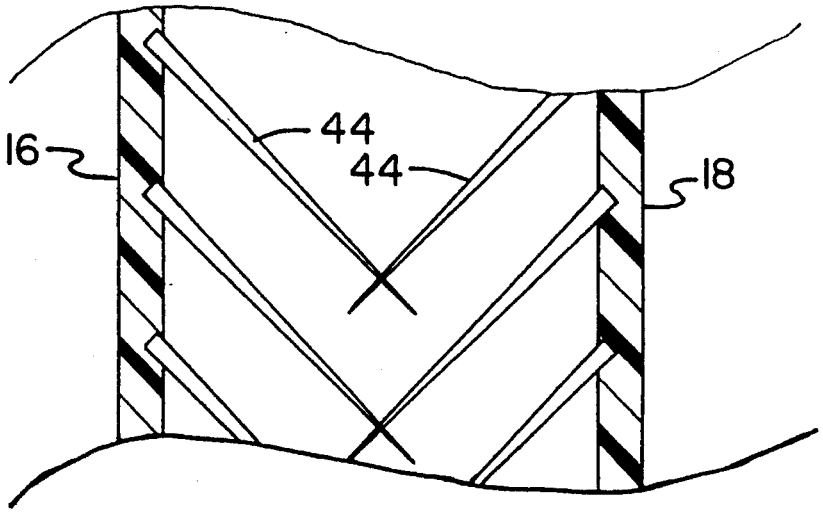
FIG. 7 is an enlarged cross-sectional view taken at circle 7 of FIG. 5.

Next provided are a plurality of semi-rigid bristles 44. The bristles are of a semi-rigid material such as nylon. The bristles are secured at their interior ends to the interior surface of the front and rear walls of the container. The bristles have enlarged interior ends and pointed exterior ends. Their axes are pointed at an angle downwardly. Such angle is about forty-five degrees with respect to the surface of the base plate. The needles are of a length to overlap at their tips. Note FIG. 5. In this manner, when a comb is inserted through the slot in the lid into the container, the comb will contact the bristles and deflect them toward the base plate. The lower end of the comb will thus become moistened at its lower extent. Upon withdrawing the comb from the container through the lid, the bristles will be deflected upwardly by the comb to form an angle away from the base plate. In this manner, the moisture of the disinfectant at the lower extent of the comb will moisten the upper bristles. Consequently, when the comb is reciprocated vertically within the container, the entire comb will become moistened and disinfected.

Coupling between the lid 28 and container 20 is ensured by a peripheral recess 48 around the lower internal edge of the lid 28 and a mating peripheral lip 52 around the upper external edge of the container. Inadvertent separation is abated.

Hairdressers and barbers have to keep a clean shop. This means cleaning up hair after each haircut and keeping the combs and brushes clean and sanitary. It is especially important for customers to know that their hair is being combed with a clean comb. Many hairdressers dislike the task of cleaning the combs because it involves the use of a disinfectant spray which tends to get everywhere.

The present invention provides the user with an effective way to clean combs without direct exposure to the disinfectant solution. Essentially, it is a jar that features a slit in the top into which the comb is inserted. Inside of the jar is a series of intersecting brushes which are made of coarse nylon bristles that are positioned above a reservoir of disinfectant. The jar is approximately 6 inches high, 4 inches wide, and 2 inches deep. A non-skid weighted bottom prevents the jar from moving or falling when in use.

Users simply insert a comb into the slot and move it in a vertical reciprocating motion. The comb travels through the brushes, which remove any debris, and into the disinfectant solution. As the comb is extracted, the brushes remove any residual disinfectant. The present invention features a conventional screw-on lid that is easily removed to access the contents for easy cleaning. This product provides an alternative way to sanitize combs without the mess associated with conventional methods.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved apparatus for cleaning and sanitizing combs through mechanical bristles and disinfectant fluids comprising, in combination:

a container having a rectangular base plate and enlarged rectangular front and rear walls and smaller rectangular side walls, each of the walls having side edges, a lower edge and an upper edge, the front and rear and side walls couple together at their side edges to form a rectangular shape and coupled at their lower edges to the base plate;

a rectangular sheet of lead integrally formed within the base plate for weighing purposes to stabilize the device;

a lid formed in a trapezoidal configuration having a lower open end, and an upper edge, the lower open end removably positioned on the upper edges of the front, rear, and side walls, the upper edge of the lid having an elongated aperture for the passage of a comb therethrough;

a water line within the container extending upwardly from the base to a distance slightly beneath the elevational midpoint of the container; and a plurality of pointed semi-rigid nylon bristles secured to the interior surfaces of the front and rear walls of the container, the bristles having axes pointing downwardly at about forty-five degrees with respect to the surface of the base plate, the bristles being of a length to overlap at their tips whereby when a comb is inserted through the slot in the lid into the container it will contact and deflect the bristles toward the base plate and moisten the lower extent of the comb and, upon withdrawing the comb from the container through the lid, the bristles will be deflected upwardly at an angle away from the base plate and become moistened by the lower end of the comb moving thereadjacent for moistening all areas of the comb when reciprocated vertically between the bristles.

2. Apparatus for cleaning and sanitizing combs through mechanical bristles and disinfectant fluids comprising:

a container having a rectangular base plate and enlarged rectangular front and rear walls and smaller rectangular side walls, each of the walls having side edges and a lower edge and an upper edge, the front and rear and side walls couple together at their side edges to form a rectangular shape and coupled at their lower edges to the base plate;

a lid having a lower open end and an upper edge, the lower open end removably positioned on the upper edges of the front and rear and side walls, the upper edge of the lid having an elongated aperture for the passage of a comb therethrough;

a water line within the container extending upwardly from the base to a distance slightly beneath the elevational midpoint of the container; and a plurality of pointed semi-rigid bristles secured to the interior surfaces of the front and rear walls of the container, the bristles having axes pointing downwardly with respect to the surface of the base plate, the bristles being of a length to overlap at their tips whereby when a comb is inserted through the slot in the lid into the container it will contact and deflect the bristles toward the base plate and moisten the lower extent of the comb and, upon withdrawing the comb from the container through the lid, the bristles will be deflected upwardly at an angle away from the base plate and become moistened by the lower end of the comb moving thereadjacent for moistening all areas of the comb when reciprocated vertically between the bristles.

3. The apparatus as set forth in claim 2, wherein the lid is formed in a trapezoidal configuration.

4. The apparatus as set forth in claim 2, wherein the bristles are formed of nylon.

5. The apparatus as set forth in claim 2 and further including a rectangular sheet of lead integrally formed within the base plate for weighing purposes to stabilize the device.

6. The apparatus as set forth in claim 2 and further including a peripheral recess around the lower internal edge of the lid and a mating peripheral lip around the upper external edge of the container.

* * * * *